US005269103A

United States Patent [19]

Nagel et al.

[11] Patent Number: 5,269,103

[45] Date of Patent: Dec. 14, 1993

[54] HONING MEASURING TOOL

[75] Inventors: Wolf Nagel, Nuertingen; Herbert Rauscher, Metzingen; Rainer Widmann, Nuertingen, all of Fed. Rep. of Germany

[73] Assignee: Nagel Maschinen-und Werkzeugfabrik GmbH, Fed. Rep. of Germany

[21] Appl. No.: 739,471

[22] Filed: Aug. 2, 1991

[30] Foreign Application Priority Data

Aug. 4, 1990 [DE] Fed. Rep. of Germany ..... 4024778

[51] Int. Cl.[5] ..... B24B 33/02; B24B 49/00

[52] U.S. Cl. ..... 51/165.74; 51/165.93; 51/165.91; 51/346; 51/34 H

[58] Field of Search ..... 51/165.93, 165.91, 165.88, 51/165.89, 346, 349, 340, 344, 34 H, 34 R, 331

[56] References Cited

U.S. PATENT DOCUMENTS

| | | | |
|---|---|---|---|
| 2,070,985 | 2/1937 | Connor et al. | 51/340 |
| 2,263,781 | 11/1941 | Kline | 51/342 |
| 2,304,930 | 12/1942 | Klein | 51/342 |
| 2,688,219 | 9/1954 | Taylor | 51/165.91 |
| 2,732,670 | 1/1956 | Foster | 51/165.89 |
| 2,777,257 | 1/1957 | Johnson | 51/165.91 |
| 4,065,881 | 1/1978 | Gillette | 51/346 |
| 4,434,588 | 3/1984 | Wada et al. | 51/346 |
| 4,945,685 | 8/1990 | Kajitani et al. | 51/165.91 |

FOREIGN PATENT DOCUMENTS

| | | | |
|---|---|---|---|
| 2062097 | 6/1972 | Fed. Rep. of Germany | 51/346 |
| 2460997 | 7/1976 | Fed. Rep. of Germany . | |
| 3039467 | 6/1982 | Fed. Rep. of Germany . | |
| 3703848 | 8/1988 | Fed. Rep. of Germany . | |
| 3827892 | 3/1990 | Fed. Rep. of Germany . | |
| 3835185 | 4/1990 | Fed. Rep. of Germany . | |
| 3842047 | 6/1990 | Fed. Rep. of Germany . | |
| 2030906 | 4/1980 | United Kingdom . | |

*Primary Examiner*—Robert A. Rose
*Attorney, Agent, or Firm*—Quarles & Brady

[57] ABSTRACT

A honing tool (1) simultaneously serving as a measuring mandrel has, apart from honing ledges (7), measuring and/or guide ledges (10), which are mounted in radially adjustable manner on the tool body (2) for increasing the measuring precision and/or for adjusting to different nominal dimensions of the hole. Thus, e.g. prior to the end of the machining of a hole, the measuring ledges (10) can be infed again and/or the desired measured value can be recalibrated by means of a calibration hole.

39 Claims, 2 Drawing Sheets

HONING MEASURING TOOL

BACKGROUND OF THE INVENTION

The invention relates to a measuring tool for in particular fine-finished surfaces, such as holes, in which the measuring tool does not have to have one or more machining members for machining said surface, but is preferably combined into a tool unit with such a machining tool, particularly a honing tool, so that machining and measurement can be performed simultaneously and not in separate operations in time-succeeding manner. Measurement is here understood to mean any non-machining function oriented by the surface to be machined and serving for the dimensional accuracy thereof, e.g. also a guidance of a tool on such a surface.

DE-OS 38 35 185 discloses a honing tool, which is simultaneously used as a pneumatic measuring tool during machining and to this end has in the vicinity of work guides a measuring jet radially directed against the wall of the hole. The dynamic pressure acting on the measuring jet serves as a reference value for the diameter of the hole. This honing tool makes it possible to achieve very good machining results for a specific nominal dimension or size. However, there is a need to increase the versality of use of honing/measuring tools.

OBJECTS OF THE INVENTION

An object of the invention is to provide a honing-/measuring tool of the aforementioned type, which avoids the disadvantages of known constructions. A further object is to permit an adaptation of its substantially non-machining operating members to the workpiece surface or hole being machined or to be machined. Further objects will be apparent from the description.

SUMMARY OF THE INVENTION

According to the invention one or more identical or different operating members are mounted in an at least partly adjustable manner on the tool body. As a function of the direction in which adjustability is possible, numerous modifications can be made to the tool by positioning or adjustment.

If the operating member is adjustable at right angles to the machining surface, e.g. in the case of increasing hole width with machining readjustment by a corresponding small amount can take place or a change can be made to different machining nominal dimensions by correspondingly larger amounts. Thus, widely differing widths can be machined on rotary surfaces using the same tool. This difference can be above one-half, one or more millimeters; however, the adjustability can also be such that the particular operating member can be transferred between an operating and a non-operating position and can in this way be replaced by at least one further operating member, which corresponds to a different machining dimension. As a result of this construction it is possible to achieve an even more accurate guidance of the tool on the workpiece surface or an even more accurate measurement of this surface. The adjustability with honing accuracy is not to be mistaken for forward and return motions in order to provide an initial and an operating state.

The inventive construction is also suitable for methods and apparatuses or honing tools according to DE-SO 38 27 892, to which reference should be made for further features and effects. Instead of machining and measuring successively in separate stations, both operations can be simultaneously performed in the same station through the inventive construction and the adjustment or readjustment can be performed during machining or the relative movement between the surface and the tool or in the intervals between machining cycles. The adjustment can take place steplessly and/or in steps.

Instead of positioning each operating number axially substantially adjacent or displaced relative to at least one machining member or with a smaller or greater length compared therewith, it is preferably identically constructed and so positioned that it is partly or entirely in the same length region of the tool body. All the machining members and several or all the measuring members or guide members and/or similar operating members can consequently be in the same length region of the tool body and act simultaneously in each tool position.

The bearing of the adjustable operating member appropriately takes place by means of a sleeve bearing, which can be a rotary and/or slide bearing and appropriately the arrangement is such that the operating member for adjustment does not have to be directly moved manually or with a tool and can instead be adjusted indirectly with a control device, which is at least partly located on or in the tool body. A control member acting on the operating member can be in the same length region of the tool body as at least one control member for at least one machining member. For operating the control member is provided at least one suitable servodrive member, which is e.g. formed by a handle mounted on the tool body or instead of or in addition thereto by a servodrive of the machine carrying the tool, which acts by means of a control rod on the control member.

The inventive construction is also suitable for those tools which have two or more sets of one or more machining members movable at right angles to the tool surface or in another direction, e.g. a first set for the rough machining and a second set for the finish-machining. At least one or all the operating members can be adjusted by means of the same control member or the same control device as at least one or all of the machining members, or a separate control member can be provided. For example at least one or all the operating members can be adjustable independently of the machining member and the operating members can be combined into groups, which are adjustable independently of one another. Thus, at least one operation member can be adjustable independently of at least one measuring member and/or together therewith. If there are several independently adjustable control members, then they are located approximately coaxially in one another or within the hollow tool body, which gives a very compact construction.

At least one operating member could admittedly be forcibly controlled in both opposite directions of its adjustability, but a simpler construction is obtained if it is only forcibly controlled in one direction, particularly that counter to the workpiece surface, whilst being loaded by at least one restoring spring in the opposite direction. The restoring spring can be jointly provided for at least two or all the operating and/or machining members.

For increasing the measuring and/or guidance precision at least one and preferably all the operating members have a ledge-like construction. With respect to the surface cooperating with the workpiece surface, the operating member appropriately has approximately the same length and/or width as at least one machining member.

By means of at least one control line the measuring member appropriately influences a control mechanism, by means of which e.g. the reaching of the finished size during machining is indicated. This control line is positionally variable with respect to the tool body at least in the vicinity of its connection to the measuring member, so as not to impede adjustment. For example the control line can be formed by a flexible hose or can have at least one correspondingly flexible intermediate portion. It is advantageously located on the outside of the tool body, but can also be located within its outer face. It is also conceivable to form the connection of the measuring member to the control line by a coupling, whose two coupling members are displaceable relative to one another without interrupting the line connection by the magnitude of the adjustment of the measuring member.

According to the invention for a honing or measuring tool of the described or a different type a calibrating or adjusting device is provided with at least one reference surface corresponding to the workpiece surface and relative to which the operating member can be aligned or a reference value for its function can be derived. For example, guide members can be precisely positioned by setting to the reference surface. In addition, the dynamic pressure of a pneumatic measuring device can be determined on this reference surface and used as a reference value for the workpiece surface measurement. The reference surface is appropriately located e.g. in the axial movement path of the tool in such a way that the operating member moves against it through a simple tool movement.

If during the machining of workpieces, e.g. piston travel paths of cylinder blocks, successively workpieces with different nominal diameters are to be successively machined in a machining line on a single honing machine or with a single honing tool or without a tool change merely by rearranging the machining members, then it is appropriate to provide a number of reference surfaces at least corresponding to the number of different nominal dimensions, so that for each setting or adjustment of the machining members a calibration or adjustment is possible. It is conceivable to provide the reference surfaces in equidirectional, stepped, successive manner, so that as a function of the setting of the operating or machining members they can be engaged with the latter by a more or less pronounced axial return of the tool, without further movements being necessary. Instead of this or in addition thereto reference surfaces can also be juxtaposed in magazine-like manner, e.g. in the manner of a rotary turret magazine or can be successively transferred into the movement path of the tool.

According to the invention a method for machining and/or measuring a workpiece surface is proposed, in which the operating member is adjusted for adapting to the workpiece surface. Preferably during the machining of a workpiece surface at least one operating member is readjusted against said surface, in order to reduce again its operating tolerances which have become larger through machining. In the case of a pneumatic measuring member, e.g. the tool can be moved back from the workpiece surface or out of the hole during said machining, then adjusted and calibrate against the reference surface for a zero balance of the control mechanism and then immediately machining can be recommenced. This avoids the disadvantages resulting from the measuring clearance between the measuring member and the workpiece surface becoming larger with increasing machining and consequently the measuring precision being decreased towards the end of machining.

An adjustment of the operating member in very small steps can be obtained by a stepped control cam of the control member and/or in that a control member with an e.g. continuously rising control cam is operated via a stepping motor, whose control steps can be precisely determined by a counter, so that the actual setting can always be precisely determined.

BRIEF DESCRIPTION OF THE DRAWINGS

These and further features can be gathered from the claims, description and drawings, in which the individual features can be realized singly or in subcombinations in an embodiment of the invention and in other fields and can represent independently protectable constructions for which protection is hereby claimed. Embodiments of the invention are described hereinafter relative to the drawings, wherein show:

DETAILED DESCRIPTION OF THE PREFERRED EMBODIMENTS

Figure 2:
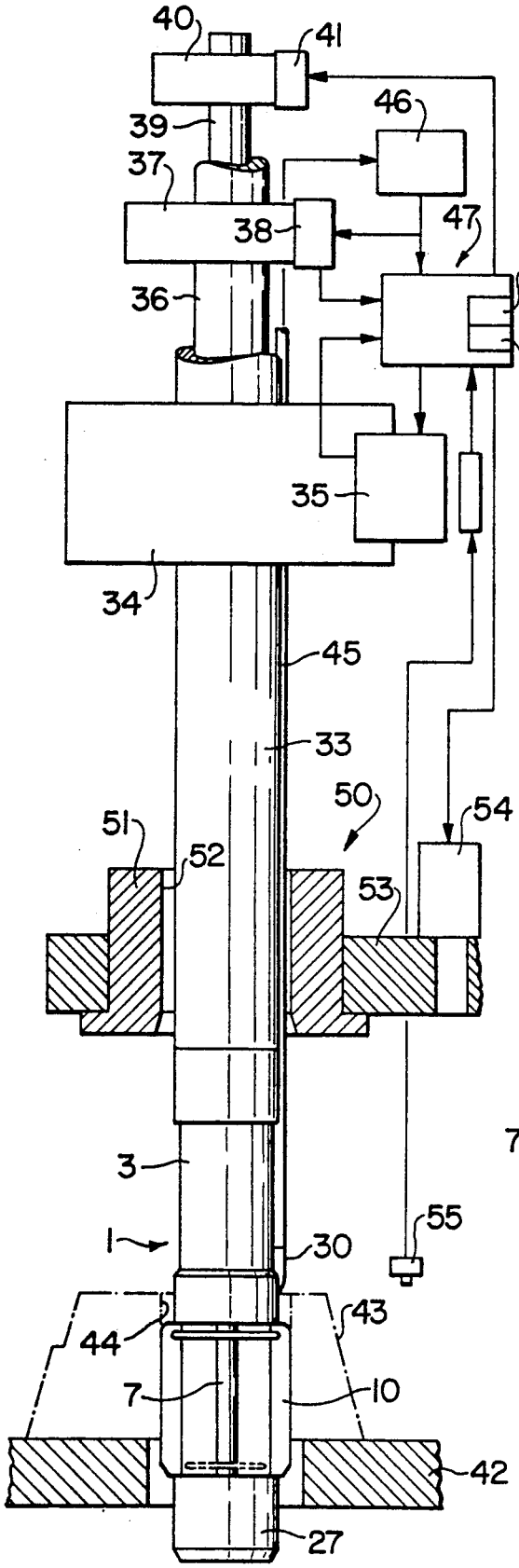
FIG. 2: An inventive machine for operating the tool in part simplified form.

The tool 1 constructed in the manner of a honing or measuring mandrel has a substantially hollow or sleeve-like tool body 2, which has at its rear end a tool shank 3 with a coupling member 4 for the cardan self-aligning connection to a rotary and/or axially and oscillatingly movable machine spindle. A front portion of the tool 1 connected to the tool shank 3 forms a tool head 5 for machining, guidance and/or measurement.

On the jacket 6 of the substantially one-part tool body 2 are several substantially identical ledge-like machining members 7 uniformly distributed around the tool axis and whereof in each case two are approximately located in a common axial plane and extend approximately axially parallel to the tool. Each machining member 7 has a support ledge 8 approximately radially guided in a longitudinal slot of the jacket 6 and having a machining lining or coating 9 on the radially outer ledge edge. In addition, in corresponding longitudinal slots of the jacket 6 are several operating members 10 substantially uniformly distributed around the tool axis and guided in approximately radially adjustable manner, whilst also having a ledge-like construction. Appropriately in each case two similar operating members 10 are located in a common axial plane. Each operating member 10 has a supporting ledge 11 and on its outer longitudinal edge a high wear-resistant coating 12. The guide slots for the machining members 7 and operating members 10 can have the same dimensions and their ends are in each case located in a common plane at right angles to the tool axis, so that the same tool body can, as a function of requirements, be equipped with a different distribution and different numbers of said members.

In a preferred construction six members are substantially uniformly distributed around the circumference, four being constructed as machining members and two as measuring/guide members. Advantageously between two adjacent machining members is provided an operating member 10 and in circumferentially alternating manner the operating members can be constructed as measuring members and guide members or the operating member 10 can be used simultaneously for measurement and guidance. The machining members 7 are adjustable with a control mechanism 13 located within the jacket 6 and the operating members 10 with a further control mechanism 14, whose sleeve-like control member 16 is guided on the inside of the jacket 6 and on whose inside is guided a control member 15 of the control mechanism 13. The control members 15, 16 have at their rear ends within the tool shank interengaging connecting members 17, 18 for connection to corresponding interengaging control rods of the machine spindle, which on inserting the tool 1 in the machine spindle are appropriately simultaneously coupled with the connecting members 17, 18 so that at least one and in particular the control member 15 is forcibly positively moved axially in both directions.

The control mechanism 15 has two axially spaced, successively located, acute-angled control cones, whose outer circumference in each case forms a control cam 19 and which are guided with connecting cylinder portions on the cylindrical inner face of the control members 16. The latter is provided on the outer circumference with two successively located, stepped control cam disks 20 with a larger axial spacing and approximately in the vicinity of the ends of the operating members 10. However, particularly when using an electronic stepping motor as the servodrive, the control cam disks can also be conical and without steps. The control cams 19 are engaged by the machining members 7 with radially inwardly directed, plate-like control cam disk 21, which project as one-piece components above the inner longitudinal edges of the support strips 8, are axially spaced from one another and have bearing faces, which are formed by their inner longitudinal edges and are approximately of the same length as the associated control cam 19.

The operating members 10 have corresponding flat plate-like control cam disks 22, which project over the inner longitudinal edge of the support ledge 11, are constructed in one piece therewith, are connected approximately to its terminal edges and have a greater axial spacing than the control cam disk 21. Each control cam disk 22 is provided with a sloping bearing face in an acute angle to the tool axis for guiding on the associated control cam 20, said bearing face appropriately passing at the cam disk end into a neutrally acting edge, which is roughly axially parallel to the tool corresponding to the associated step faces of the control cam 20. The control cam disks 21 pass through passages 23 in the form of longitudinal slots in the jacket of the control members 16. These passages 23 are longer than the control cam disks 21 at least by the maximum control path of the control members 16 and separate passages 23 are provided for successive control cam disks 21 and between their ends is located a portion of the jacket of the control members 16. The bearing surfaces of the control cam disks 21 or 22 can be pointed in cutting edge-like manner in cross-section or provided with corresponding flanks, so that it is still possible to house a large number of e.g. sixteen machining or operating members if the smallest distance of the associated control cam 19 or 20 from the tool or control axis is only a few millimeters.

The machining members 7 and the operating members 10 are radially inwardly spring loaded by common springs 24, 25, which can serve as means for positively retracting the non-machining operating members 10 away from the machining face 44. To ensure that only two springs 24, 25 are required, they are formed by circlips, which engage in slots in the vicinity of the ends of the support ledges 8, 11. Through the springs 24, 25 the control cam disks 21, 22 are engaged without clearance on the control cams 19, 20. The control member 16 is appropriately only forcibly movable in its control movement directed towards the front tool end associated with the infeed and is moved in the opposite direction by a restoring spring 26, acting in the vicinity of the front end on the control member 16, is equiaxial thereto, is located in the longitudinal direction upstream of the front ends of the machining/operating members 7, 10 or control members 15, 16 and is appropriately located in a spring housing 27 formed by the front end of the jacket 6 of the tool body 2. Through the described construction the jacket 6 can have a substantially constant inside width over its total length for guiding the control members 16 and/or for receiving the restoring spring 26.

Roughly in the centre of the length and/or width of its working surface, which extends approximately over the entire length of the support ledge 11, the operating member 10 has a jet opening of a measuring jet 28 directed roughly at right angles to said working surface and which is formed by a jet bore in the lining 12. This jet bore is connected by its inner end to the end of a channel 29, which is provided as a bore in the support ledge 11 and emanates from its rear, terminal edge. For connecting the measuring jet 28 to a pressure source or acquisition device for the pressure the tool 1 carries a connection 30, e.g. a plug connection, to which can be connected a corresponding tube or hose of the machine. To this end on the operating member 10 or on the support ledge 11 is fixed a coupling piece e.g. in the form of a S-shaped offset pipe bend, which projects freely rearwards in the vicinity of the outer circumference of the jacket 6 and is fixed by plugging in to a correspondingly widened end portion of the channel 29 on operating member 10. The coupling piece 31 engages by its portion connected to the terminal edge of the operating member 10 in a pocket 32 formed by an axial groove on the outer circumference of the jacket 6, in such a way that it can in unhindered manner perform the radial movements of the operating member 10 with respect to the jacket 6.

The tool 1 is intended for use on a machine according to FIG. 2 and is fixed to its working spindle 33. The latter is movable in axial and rotary manner with an operating drive 34, a servomotor 35 of said drive 34 being so constructed that the tool 1 can be transferred into different axial or operating positions and can be held in the said position. In the hollow working spindle 33 is axially displaceable a hollow control rod 36 or, is rotary mounted, if one of the described control movements of the tool is a rotary movement and not an axial movement and by means of a control mechanism 37 is moved with a servomotor 38 and is used for operating the control mechanism 14. A control rod 39 is also mounted in rotary and/or displaceable manner in the control rod 36 for operating the control mechanism 13 and can be driven by means of a control mechanism 40 with a stepping motor 41. The control mechanisms 37, 40 can act in each axial position of the working spindle 33.

The workpiece 43 to be measured or machined is to be so arranged on a machine table 42, optionally with a conveying means, that it can be moved at right angles to the tool axis in a row with further workpieces into and out of the working region of the tool 1. On the workpiece 43 machining is to take place on an inner surface 44 in the form of a hole. The connection 30 of the operating member 10 is connected via a line 45 guided upwards along the working spindle 33 to a converter 46 in which the air pressure applied to the measuring jet 28 and accumulated to a greater or lesser extent by the surface 44, as a function of the distance, is converted into an electrical value, which e.g. via a feedback control supplies corresponding signals to a control means 47 or its measured value acquisition means 48. The control means 47 also receives from the operating drive and/or from one or both control mechanism 37, 40 state signals as to the position or setting state of the tool 1 or the machining and operating members 7, 10. These signals are processed in a processor to control pulses through which are controlled the servodrive 35 and the control mechanisms 37, 40.

In order to be able to recalibrate the operating members 10 at any time, outside the working area of the tool 1 and between the machine spindle head having the working drive 34 and the machine table 42 is provided an adjusting device 50 with a calibrating ring 51, which is coaxially traversed by the working spindle 33. As soon as the measured value acquisition means 48 establishes an inadequate dynamic pressure, the tool 1 in program-controlled manner via the working drive 34 is drawn back into the calibrating ring 51 and the operating members 10 are adjusted by a predetermined amount via the control mechanisms 37. By means of the reference surface 52 of the calibrating ring 51 coinciding with the finish-machined surface 44 it is then possible to determine via the measured value acquisition means 48 the associated signal value of the reference dynamic pressure and via a zero balance 59 can be fixed as the starting value for the further measurement of the surface 44. Following this operation the tool 1 passes back into the curved surface 44 and continues machining.

The control means 47 can also be provided for compensating wear to the machining members 7. As soon as the measured value acquisition means 48 establishes that the amount measured by the operating members 10 diverges by a given amount from the desired value, a signal is supplied to the infeed mechanism, which allows the corresponding compensation steps to be performed by the servomotor 41. Instead of this the wear compensation can also be carried out on the basis of an empirically determined value, which results from a given machining time and intensity.

However, the inventive machine is also suitable for machining surfaces 44 with different nominal dimensions successively using the same tool 1. However, in order to be able to still carry out recalibrations without complicated reequipping of the machine, the adjusting device 50 has in a magazine 53 a corresponding number of calibrating bodies or rings 51, which have reference surfaces 52 corresponding to the nominal dimensions which occur. The magazine can e.g. be a turret magazine, which is so rotatable about a spacing axis parallel to the tool axis by means of a servomotor 54, that each calibrating ring can be brought into a position equiaxial to the tool 1. The lifting drive of the working spindle 33 is constructed in such a way that after passing through the calibrating ring 51 the tool 1 can be completely retracted with respect thereto and consequently releases the magazine 53 for said indexing. In place of a turret magazine it would also be possible to provide a magazine displaceable in linear or right-angled manner to the tool axis in corresponding mounting supports or bearings of a machine frame.

Figure 1:
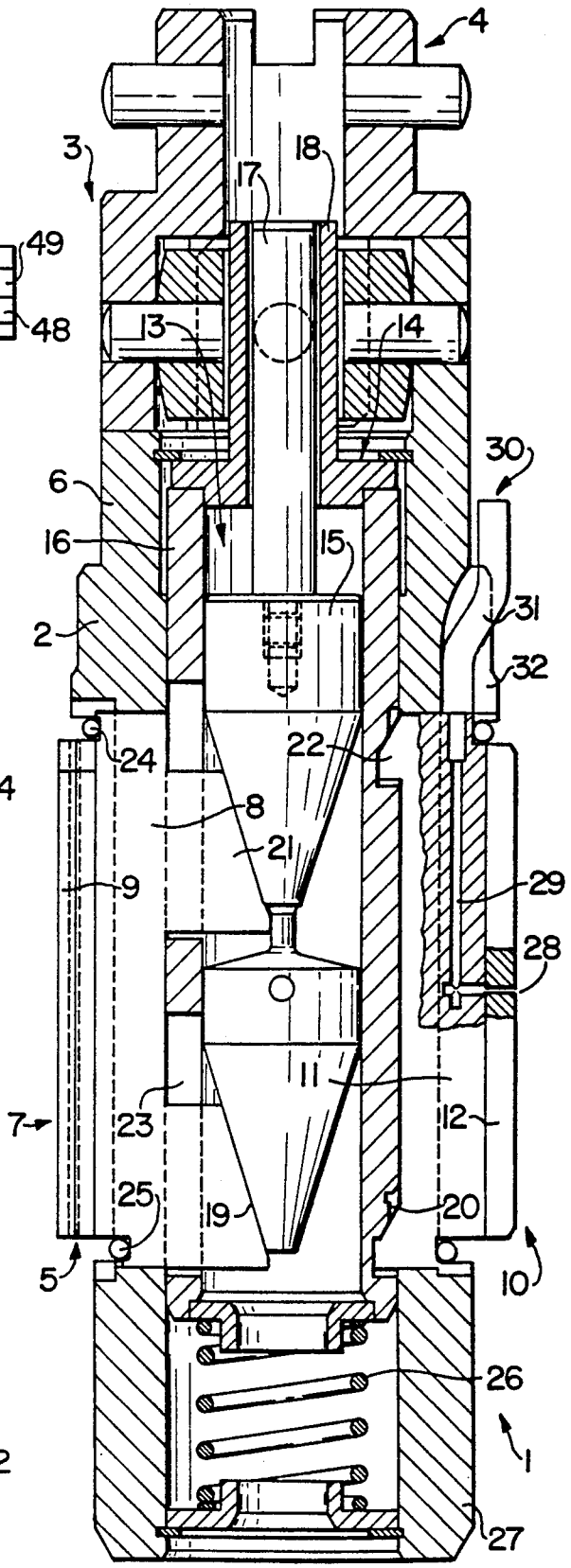
FIG. 1: An inventive tool in axial section.

FIG. 1 shows the tool in its setting for the minimum nominal diameter. For machining a hole with a larger nominal diameter the machining members 7 are infed via the control mechanisms 13, 40. Substantially simultaneously the operating members 10 are correspondingly infed via the control mechanism 14, 37. So that the correct setting can be automatically performed, in the conveying path of the workpieces 43 can be provided a sensor 55 for a corresponding coding or the like on the workpieces 43 and from which the nominal dimension to be machined can be gathered. The sensor 55 provides this information as a coded signal to the processor of the control means 47, which then performs the said settings in the described manner and brings about the successive working steps of the adjusting device 50 necessary in order to bring the associated calibrating ring 51 into the operating position.

Figures 3, 4:
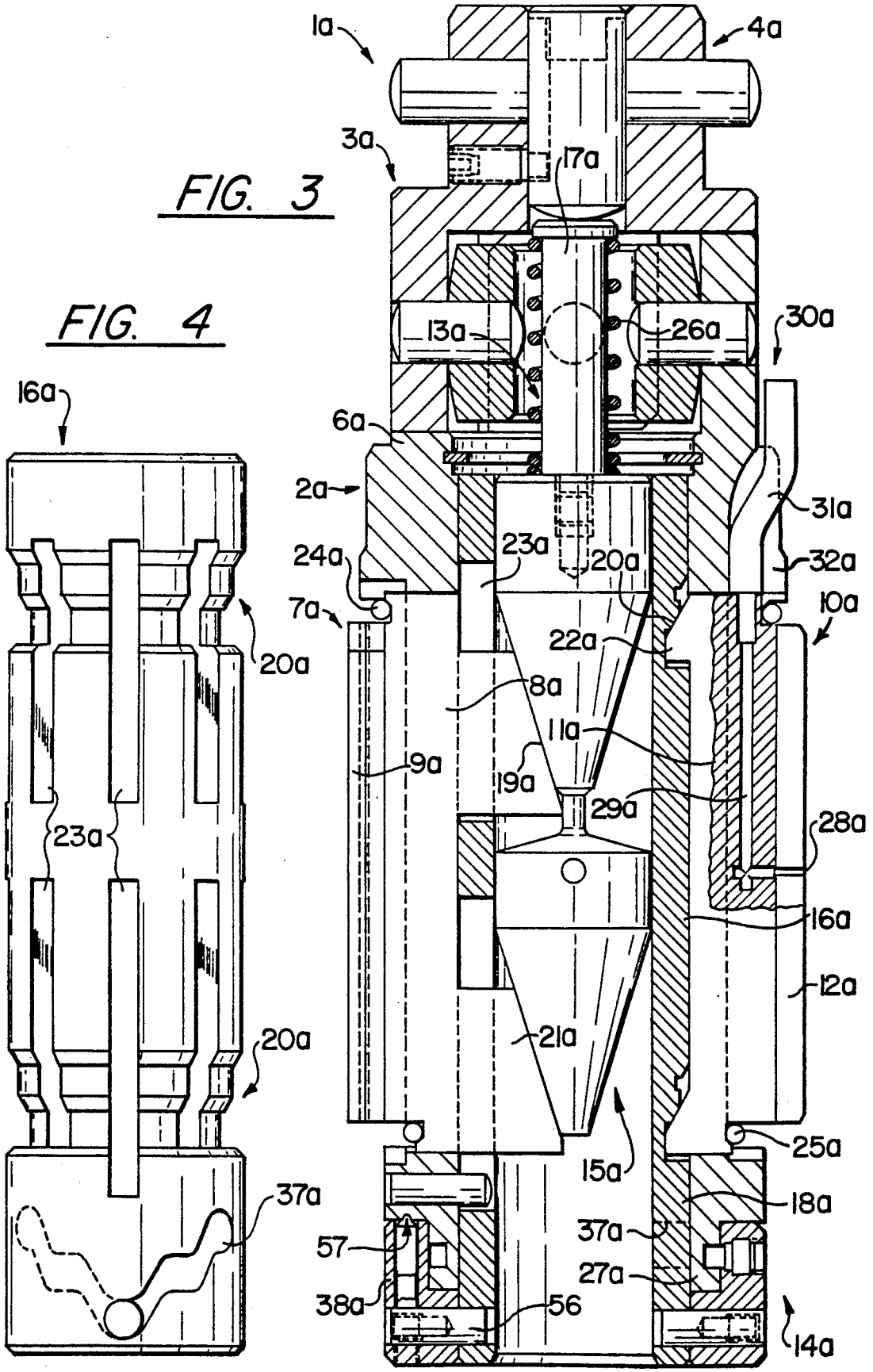
FIG. 3: Another embodiment of a tool in a representation corresponding to FIG. 1.
FIG. 4: A view of a control member.

In FIGS. 3 and 4 corresponding parts are given the same reference numerals as in FIG. 1, but followed by the letter "a", so that corresponding description parts also apply to this embodiment. The different or identical constructions according to FIGS. 1 and 3 can be provided jointly or multiply on a tool. The control mechanism 14*a* in this embodiment is located in the vicinity of the front end of the tool 1*a* and is appropriately operable manually with a handle in the form of a control ring 38*a* instead of with a servomotor located on the tool body 2*a*. The control member 16*a* is extended forwards over the associated end of the tool body 2*a* or its end portion 27*a* and is surrounded by the control ring 38*a*, which engages by means of cam disks 56, e.g. two equiaxial, radial pins in link guides 37*a* of the control member 16*a*, which are provided as stepped slots in its front end and have an axial pitch in the manner of a stepped helix. The control ring 38*a* engages over the front, correspondingly diameter-reduced end of the tool body 2*a* and is rotatable but axially secured with respect thereto, which can e.g. be brought about by radially inwardly projecting cam disks, which adjustably engage in a ring groove of the tool body 2*a*.

To ensure that the control ring 38*a* is locked in the rotary position, appropriately a locking mechanism 57 is provided, which can be positioned in the vicinity of the rear face of the control ring 38*a* and a ring shoulder of the tool body 2 adjacent thereto. Thus, within an outer jacket part of the control ring 38*a* can be movably arranged an axially spring-loaded locking member, with which is associated in the ring shoulder a ring of closely juxtaposed locking depressions, so that following each control step of a few radians the control ring 38*a* is again automatically secured. Apart from the engagement of the control cam disks 21*a* in the passages 23*a*, the control member 16*a* is also secured axially and or against rotation in that at least one of the passages 23*a* is extended forwards and in the extension a radial pin engages in the front end of the tool body 2*a*. Rotary movements of the control ring 38*a* lead to corresponding axial control movements of the control member 16*a* and to a radial control movement of the operating members 10*a*.

Through the described construction of the control mechanism 14*a* the tool 1*a* can only be operated with a control mechanism 40 for the machining members 7*a*. The associated control member 15*a* is in this case loaded in the return direction by a restoring spring 26*a*, which surrounds a shank detachably fixed to the rear end of the control member, or the connecting member 17*a*, so that the control rod 39 does not have to be positively coupled to the connecting member 17*a* or a thrust bolt connected to the rear thereof.

The control member 16*a* can be constructed from a through pipe section having constant cross-sections. On its outer circumference are then produced in the manner of circular grooves the control cams 20*a* with correspondingly stepped bottom faces and sloping flanks for the associated control cam 22*a*. In addition, the passages 23*a* are produced, which appropriately project over the inner and/or outer end flank of the particular control cam 20*a*, so that said control cam is formed by cam segments distributed over the circumference and whereof in each case one is provided for controlling an operating member 10*a*. In the represented embodiment there are eight operating members 10*a* and eight machining members 7*a* located between them. Advantageously six operating members 10*a*, whereof two are located in a common axial plane, only form guide members without measuring jets, whilst two adjacent operating members 10*a* located approximately in a common axial plane are constructed as measuring members. At least the vicinity of the jet openings 28, 28*a* or the complete working surface of the measuring member is appropriately continuously adjusted so that said area remains contact-free with a limited spacing with respect to the machining surface 44.

The inventive construction can also be provided for the honing tools known under the trademark Precidor according to the Applicant's German patent 24 60 997, to which reference should be made for further features and effects.

We claim:

1. A honing measuring tool for operating in the vicinity of a machining face and for measuring the machining face, said tool comprising:

a basic tool body;

measuring means for measuring the machining face as a function of a measuring perimeter; and at least one non-machining operating member provided on said tool body for moving along the machining face, at least one of said at least one operating member being adjustably mounted with respect to the machining face;

wherein means are provided for positively retracting at least one of said non-machining operating member away from the machining face in a direction traverse to the machining face and independently from engagement of said tool with the machining face.

2. The tool according to claim 1, wherein said at least one operating member is adjustably mounted in a direction traverse to the machining face, said retracting means being provided for varying said measuring parameter as a function of positionally retracting at least one of said non-machining operating members.

3. The tool according to claim 1, wherein said tool defines a tool axis, at least one of said operating member being guided in an opening of a jacket of said tool body substantially radially to said tool axis, control means being provided for positionally readjusting at least one of said non-machining operating member substantially during machining of the machining face.

4. The tool according to claim 1, wherein at least one machining member is provided in a length section of said at least one operating member, said operating member being located substantially in a length section of said at least one machining member.

5. The tool according to claim 1, wherein at least one machining member is provided and defines a length extension, said at least one operating member having substantially a same length extension as said at least one machining member.

6. The tool according to claim 1, wherein at least one machining member is provided, said at least one operating member and said at least one machining member defining a total number of members, said tool body defining a length section having section ends, said total number of members being substantially located in said length section and extending substantially up to said section ends, said total number being at least two.

7. The tool according to claim 1, wherein at least one control member is movably mounted on said tool body, said at least one operating member being adjustable by said at least one control member.

8. The tool according to claim 7, wherein said at least one control member is operationally axially displaceable.

9. The tool according to claim 7, wherein said at least one control member is located substantially entirely within said tool body.

10. The tool according to claim 7, wherein at least one machining control member is provided for adjusting said at least one machining member, said at least one control member for said at least one operating member and said at least one machining control member being located at least partly in a common length section defined by said tool body.

11. The tool according to claim 7, wherein at least one machining control member is provided for adjusting said at least one machining member, said at least one machining control member and said at least one control member for said at least one operating member being located within one another, thereby providing an inner control member and an outer control member.

12. The tool according to claim 11, wherein said outer control member provides a sleeve substantially enveloping said inner control member, said sleeve having at least one passage receiving at least one operating follower for said inner control member.

13. The tool according to claim 7, wherein said at least one control member has at least one control cam for adjustably linking to said at least one operating member.

14. The tool according to claim 13, wherein said at least one control member has two longitudinally arranged control cams for operating said at least one operating member.

15. The tool according to claim 12, wherein said at least one control cam and said at least one passage are located laterally adjacent to one another.

16. The tool according to claim 1, wherein said at least one non-machining operating member is positionally adjustable transverse to the machining face by at least one of a stepwise operating stepping motor and a stepped control cam for providing separate measuring ranges of said tool by stepwise separated cam levels, control means being provided for continuously positionally readjusting at least one of said operating member in each of said measuring ranges.

17. The tool according to claim 16, wherein said control means is constructed to operate stepwise between different machining nominal dimensions defined by adjusting positions of said at least one operating member differing in a direction transverse to the machining face, said measuring means being adjustable for adjusting said measuring parameter to separate ones of said machining nominal dimensions.

18. The tool according to claim 16, wherein at least one cam follower engages said stepped control cam.

19. The tool according to claim 1, wherein said at least one operating member is spring loaded in an adjusting direction.

20. The tool according to claim 1, wherein said at least one operating member is spring loaded with at least one circlip.

21. The tool according to claim 1, wherein at least one machining member is provided, said at least one machining member and said at least one operating member being loaded with a common restoring spring.

22. The tool according to claim 1, wherein said at least one operating member provides at least one of members defined by a measure detecting member and a guide member, at least two substantially diametrically facing ones of said operating members being provided.

23. The tool according to claim 1, wherein at least two machining members are provided, said at least one operating member being provided between said at least two machining members.

24. The tool according to claim 1, wherein at least one machining member is provided, at least one of said at least machining member being continuously adjustable between different machining nominal dimensions defined by adjusting positions of at least one of said at least one machining member differing in a direction transverse to the machining face, said measuring means being provided for adjusting said measuring parameter to separate ones of said machining nominal dimensions.

25. The tool according to claim 1, wherein a total number of at least two operating members is provided, said total number of operating members being commonly adjustable.

26. The tool according to claim 1, wherein said at least one operating member is adjustable by at least one of control mechanisms defined by a manually operable control mechanism located on the tool body and a control mechanism of a tool machine receiving a tool shank of said tool.

27. The tool according to claim 26, wherein said manually operable control mechanism has a control ring mounted adjacent to an operating section defined by a front end of said tool body.

28. The tool according to claim 1, wherein is provided a control member positively forcibly controlled in opposite motion directions for adjusting at least one of said at least one operating member.

29. The tool according to claim 1, wherein a control member connected via at least one control link with a rotary control ring lockable in rotational positions with a locking mechanism is provided for adjusting at least one of said at least one operating member.

30. The tool according to claim 1, wherein said at least one operating member has a measuring nozzle for a pressure medium.

31. The tool according to claim 1, wherein said at least one operating member supports a supply connection for a fluid provided by a member rigidly fixed to said operating member.

32. The tool according to claim 31, wherein said supply connection movably engages in a pocket of said tool body.

33. The tool according to claim 1, wherein means are provided for gauging said at least one operating member.

34. The tool according to claim 33, wherein said gauging means comprises at least one reference face for said operating member, said reference face being located apart from the machining face and in a motion path of said tool when in an operational state.

35. A honing measuring tool for operating in the vicinity of a machining face and comprising:

a basic tool body;

at least one non-machining operating member provided on said tool body for moving along the machining face, wherein said at least one operating member is adjustably mounted, means being provided for gauging said at least one operating member, said gauging means comprising at least one reference face for said operating member, said reference face being located apart from the machining face and in a motion path of said tool when in an operational state, a number of at least two reference faces being provided for different machining nominal dimensions defined by adjusted positions of said at least one operating member and arranged in at least one of relations defined by:

an axially following arrangement and a juxtaposed arrangement.

36. The tool according to claim 35, wherein at least two of said reference faces are located on a magazine and are operationally transferable between an operating position and a resting position.

37. The tool according to claim 36, wherein said magazine is movably mounted for transferring said reference faces.

38. The tool according to claim 1, wherein means are provided for detecting, simultaneously with operation of said tool, an operating accuracy defined by said at least one operating member, control means controlled by said detecting means being provided for operating at least one of functions defined by:

positionally readjusting said operating member; and regauging said operating member as a function of falling below a predetermined value of said operating accuracy.

39. The tool according to claim 38, wherein means are provided for displacing said tool in combination with a machine spindle into at least one of positions defined by a position withdrawn from said machining face and a position operationally engaged with a reference face, said positions being associated with at least one of said functions.

* * * * *